US008678222B2

(12) United States Patent
Thorpe et al.

(10) Patent No.: US 8,678,222 B2
(45) Date of Patent: Mar. 25, 2014

(54) AIRTIGHT COMPACT

(75) Inventors: Timothy Thorpe, Santa Monica, CA (US); Adrian C. Apodaca, Santa Monica, CA (US)

(73) Assignee: HCT Asia Ltd, Central (HK)

( * ) Notice: Subject to any disclaimer, the term of this patent is extended or adjusted under 35 U.S.C. 154(b) by 751 days.

(21) Appl. No.: 12/772,109

(22) Filed: Apr. 30, 2010

(65) Prior Publication Data

US 2011/0266297 A1 Nov. 3, 2011

(51) Int. Cl.
*B65D 41/04* (2006.01)

(52) U.S. Cl.
USPC ..... 220/291; 220/DIG. 26; 132/293; 206/823

(58) Field of Classification Search
USPC ..... 220/810, 831, 811, 237, 833, 223, 291, 220/DIG. 26; 132/293, 295, 294, 300, 297, 132/296; 206/823, 581, 225, 235
See application file for complete search history.

(56) References Cited

U.S. PATENT DOCUMENTS

| | | | | |
|---|---|---|---|---|
| 1,748,491 | A * | 2/1930 | May | 220/291 |
| 5,353,818 | A | 10/1994 | Suzuki et al. | |
| 5,713,471 | A * | 2/1998 | Gueret | 206/581 |
| 5,875,795 | A | 3/1999 | Bouix | |
| 6,119,891 | A * | 9/2000 | Favre | 220/811 |
| 6,173,719 | B1 * | 1/2001 | Petit | 132/294 |
| 6,336,460 | B2 * | 1/2002 | Yuhara | 132/295 |
| 7,614,405 | B2 | 11/2009 | Allen et al. | |
| 2002/0162565 | A1 * | 11/2002 | Sebban | 132/293 |
| 2007/0131240 | A1 | 6/2007 | Prague | |
| 2008/0302384 | A1 | 12/2008 | Parker | |
| 2009/0272399 | A1 * | 11/2009 | Kim | 132/293 |
| 2009/0320874 | A1 | 12/2009 | Boye et al. | |

FOREIGN PATENT DOCUMENTS

WO WO2008010628 A1 1/2008

OTHER PUBLICATIONS

Nest-filler, retrieved on May 5, 2010 at <<http://www.nest-filler.com/cosmetics/view.htm?pageno=&bimil=&searchword=&idx=1328&cate1=1220334097&cate1_1=&cate2=&cate3=,>>1 page.
Japanese patent 2533414.

* cited by examiner

*Primary Examiner* — Jeffrey Allen
(74) *Attorney, Agent, or Firm* — Lee & Hayes, PLLC

(57) ABSTRACT

An airtight compact that contains a volatile product until a time of use. The airtight compact includes a translucent and fragile pot partially encased by a base assembly, which has a rotatable lid assembly pivotably coupled to the base assembly. The rotatable lid assembly comprising a liner overmolded to an inner lid that directly seals to a rim of the fragile pot partially encased by the base. The fragile pot may be formed of a translucent glass, which is protected by the base and the rotatable lid assemblies.

14 Claims, 5 Drawing Sheets

AIRTIGHT COMPACT

BACKGROUND

Vessels exist that are portable, convenient to use, and designed to contain volatile and/or aggressive products for use. These types of portable vessels usually consist of a jar and lid assembly, that when assembled together provide an effective barrier for containing the volatile product. The airtight portable vessels may be designed to contain the volatile product with minimal weight loss. Moreover, the airtight portable vessels are designed to contain the volatile product with minimal environmental communication. The jar and/or lid are typically made of a glass, a plastic, a metal, combinations of the foregoing, or the like, that when closed together create an airtight seal. These jar and lid assemblies may be sealed by a thread fastening mechanism, a snap fastening mechanism, or a clamp fastening mechanism, that when fastened together usually compress an o-ring or a gasket interposed by the jar and the lid. Such vessels are used in the cosmetics and personal care industries for containing a product to be applied to a body, where, as described above, the product to be applied to the body is volatile and/or aggressive. As such, without the vessels effective barrier the product may degrade and/or expire. While, existing portable vessels may provide an effective barrier for containing a volatile product, they may be fragile or brittle in nature, and may have loose parts, which make them susceptible to damage and difficult to manage.

Portable vessels have been developed to contain volatile products in a compact and airtight assembly and are built with a plastic pot and a loose plastic lid that are housed by a protective shell. However, because these vessels have a loose lid, it is difficult to manage both the loose lid and the protective shell while applying the contained product to a body. Further, because the product is contained in the plastic pot, these vessels may not be suitable for containing a volatile product to be applied to the body. Also, because these vessels are configured to compress a gasket interposed between the plastic pot and the loose plastic lid by tightening a lid of the outer protective vessel onto the loose plastic lid, it is difficult to achieve sufficient compression of the gasket. As a result, the gasket is indirectly compressed by the protective vessel and the resulting seal is poor compared to a gasket directly sealed by a single lid.

SUMMARY

This summary is provided to introduce simplified concepts of airtight compacts for containing a volatile product in a pot, directly sealed by a rotatable lid pivotably attached to a base. The compacts are further described below in the Detailed Description. This summary is not intended to identify essential features of the claimed subject matter, nor is it intended for use in determining the scope of the claimed subject matter.

In one implementation, the airtight compact comprises a pot that is at least partially encased by a base assembly and a rotatable lid assembly pivotably coupled to the base assembly. The rotatable lid assembly pivotably coupled to the base assembly is configured to removably lock to the base assembly and directly squish a liner fixed to a bottom surface of the rotatable lid assembly to a rim of the pot.

In some implementations, the airtight compact comprises a rotatable lid assembly having a liner over-molded to a bottom surface of the lid assembly. The rotatable lid assembly is pivotably coupled to the base assembly and is configured to removably lock to the base assembly and directly compress the liner to the rim of the pot.

In some implementations, the airtight compact comprises a translucent pot that is at least partially encased by the base assembly which has the rotatable lid assembly pivotably coupled thereto. The translucent pot may comprise a plastic (e.g., Surlyn® made by DuPont™), a glass, or any other suitable material having high-barrier characteristics. As used herein, translucent materials are those that allow passage of light, and include materials that are transparent, clear, colorless, and tinted, as long as they allow passage of a substantial amount of light so that the volatile product is visible through the material of the pot. Further, the base assembly may be configured with an opening for providing visibility to the translucent pot and the volatile product contained therein.

In some implementations, the airtight compact may comprise a bottom assembly for easily removing and installing a replaceable translucent pot. Here, the replaceable translucent pot is at least partially encased by the base assembly of the airtight compact. For example, a user may wish to carry on their person a particular color of volatile product. In this case, the user may easily remove the translucent pot containing the undesirable color from the base assembly of the airtight compact and easily install a different translucent pot containing a volatile product having the desired color. It is contemplated that the replaceable pot may comprise a disposable peel away seal that is removed subsequent to installing a replaceable pot. Likewise, it is further contemplated that a storage lid may be snapped on the removed translucent pot for later use.

Depending on the desired esthetic and mechanical properties of the airtight compact, components may comprise plastic, glass, and/or metal. For example, as discussed above the pot may comprise terpolymer (e.g., Surlyn® made by DuPont™) or glass. Further, the base assembly at least partially encasing the pot may comprise acrylonitrile butadiene styrene (ABS), styrene acrylonitrile (SAN), metal, or any other suitable material, or the like that is suitable for forming individual components of the base assembly. Likewise the rotatable lid assembly pivotably coupled to the base assembly may also comprise ABS, SAN, or metal, as well as, polypropylene (PP), silica gel, rubber, thermoplastic elastomer (TPE), silicone, neoprene, or any other suitable material, or the like that is suitable for forming individual components of the rotatable lid assembly.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to airtight compacts for containing a volatile product in a pot that is directly sealed by a rotatable lid pivotably attached to a base assembly of the airtight compact. The pot may be made of materials such as a translucent glass or a translucent terpolymer, which provide the necessary barrier properties for containing the volatile product, as well as provide visibility to the volatile product contained therein. However, because these materials can be brittle and fragile the pot may be at least partially encased by the base assembly. The base assembly may protect the pot while providing structural strength for pivotably attaching the rotatable lid thereto. The rotatable lid pivotably attached to the base assembly may be configured to removably lock to the base assembly and directly seal the pot. With the rotatable lid assembly pivotably coupled to the base assembly partially encasing the pot, the airtight compacts may remain intact during a time of use. For example, the user may simply loosen the rotatable lid assembly from the base assembly and apply the volatile product to a body without detaching the rotatable lid assembly from the base assembly. To seal and isolate the volatile product from the environment until a time of use, the user may simply tighten the rotatable lid assembly to the base assembly and directly seal the pot.

The base assembly may comprise a base disposed about an outer wall of the pot and a base plate coupled to the base disposed along a bottom surface of the pot. The base plate may comprise an opening for providing visibility to the pot at least partially encased by the base and the base plate. Further, an o-ring is interposed between the pot and the base plate for supplementing manufacturing tolerances of the base assembly, as well as for dampening the pot partially encased by the base assembly.

The rotatable lid assembly pivotably attached to the base assembly may comprise a lid ring pivotably coupled to the base of the base assembly. The lid ring pivotably coupled to the base of the base assembly may comprise a channel for rotatably coupling a lid and multiple pockets for coupling an inner lid. A liner may be fixed to a bottom surface of the inner lid, which may be configured to seal the rotatable lid assembly to a rim of the pot when the rotatable lid assembly is tightened to the base. The liner may be fixed to the bottom surface of the inner lid by a fastening mechanism (e.g., clips or a captive groove), an adhesive, or any other suitable fastening mechanism. Further, the inner lid and the liner may be formed of an integral layered unit. For example, the liner may be over-molded to the bottom surface of the inner lid. Further, the liner may comprise silica gel, rubber, TPE, silicone, or neoprene and the inner lid may comprise PP.

Illustrative Airtight Compact

Figure 1:
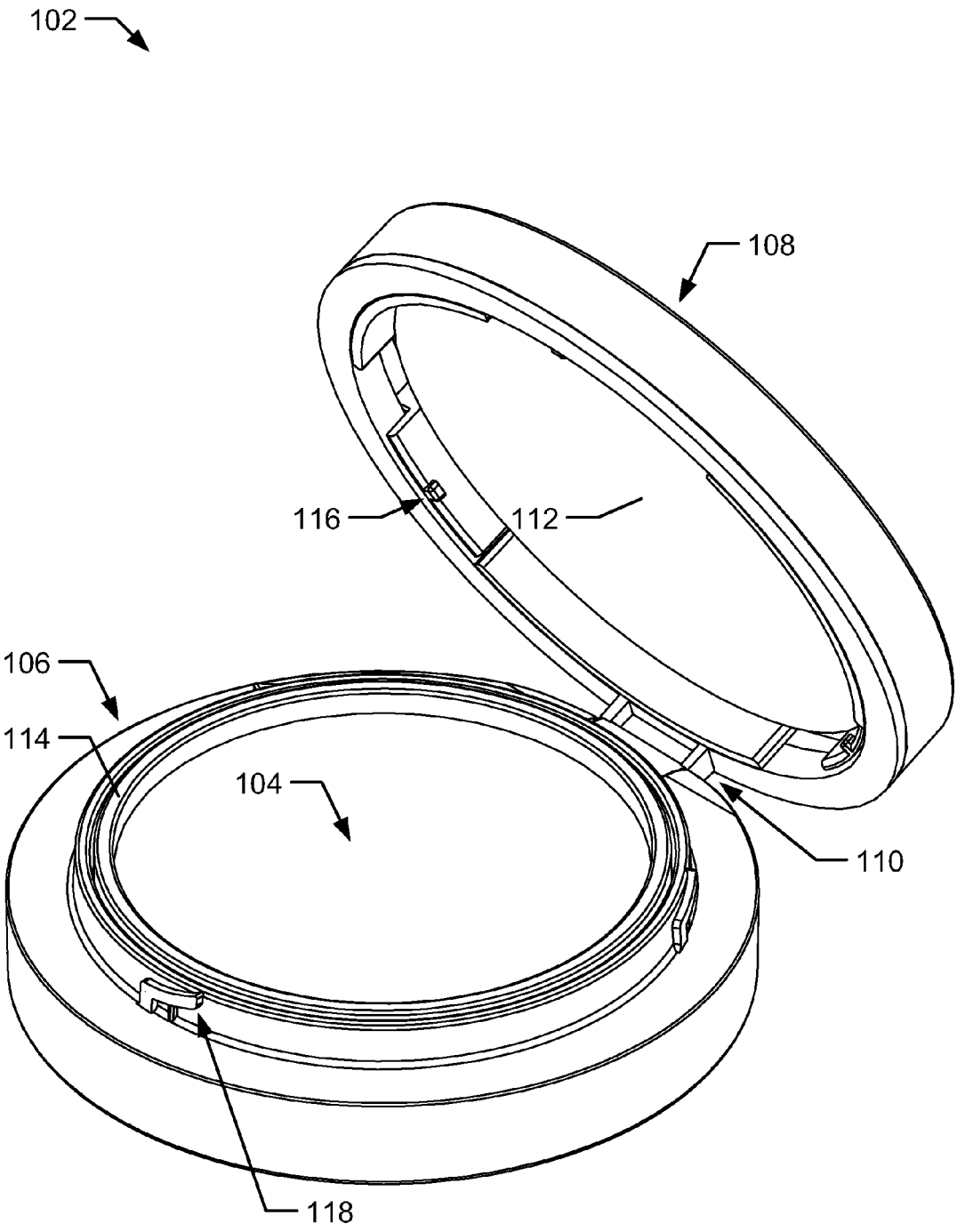
FIG. 1 illustrates an example airtight compact in an open position.

FIG. 1 illustrates an example airtight compact 102 in an open position. The airtight compact 102 illustrated in FIG. 1 comprises a pot 104 at least partially encased by a base assembly 106 for containing a volatile product, such as a makeup to be applied to a body. The airtight compact 102 is further illustrated in FIG. 1 as having a rotatable lid assembly 108 pivotably coupled, via a hinge assembly 110, to base assembly 106. Further, FIG. 1 illustrates a liner 112 fixed to a bottom surface of rotatable lid assembly 108, which is configured to directly seal the rotatable lid assembly 108 to a rim 114 of pot 104. FIG. 1 illustrates rotatable lid assembly 108 having a male bayonet fastening mechanism 116 arranged along a perimeter of the rotatable lid assembly 108 configured to mate with a female bayonet fastening mechanism 118 arranged along an outer surface of the base assembly 106. However, although not shown in FIG. 1, other fastening mechanisms may be used to fasten the rotatable lid assembly 108 to the base assembly 106.

Figure 2:
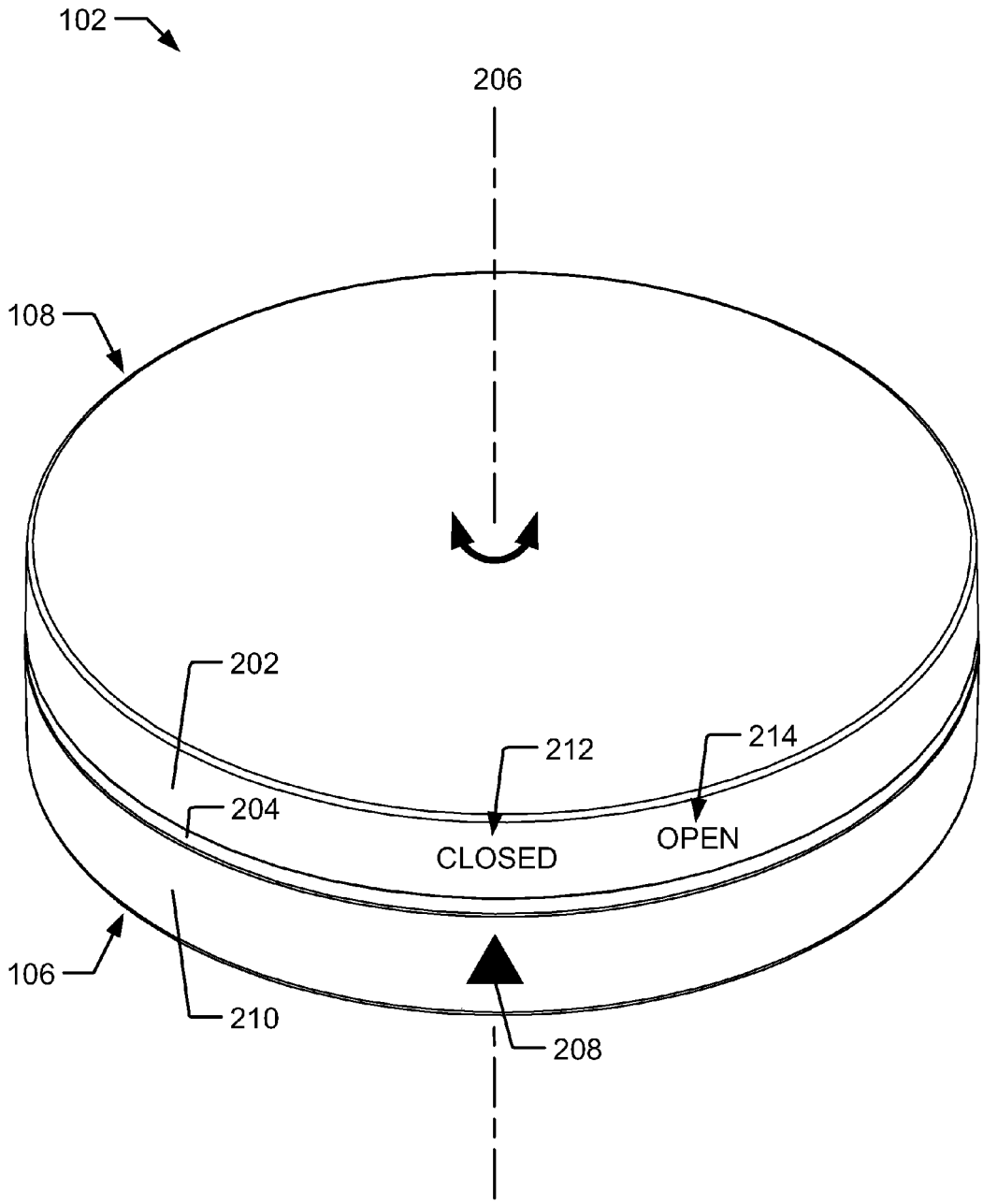
FIG. 2 illustrates an example airtight compact in a closed position.

FIG. 2 illustrates the airtight compact 102 of FIG. 1 in a closed position. Here, the airtight compact 102 is illustrated having a lid 202 of the rotational lid assembly 108 rotatably attached to a lid ring 204. As illustrated in FIG. 2, the lid 202 is configured to rotate approximately about twenty-degrees in either a counter clock-wise direction or a clock-wise direction about a longitudinal axis 206 disposed substantially proximate to a center of the airtight compact 102. Rotation of the lid 202 may be to unlock and lock the rotatable lid assembly 108 from the base assembly 106. FIG. 2 further illustrates a mark 208 disposed on a base 210 of the base assembly 106, which indicates when the lid 202 is rotated to a closed position 212 (i.e., a locked position) or an open position 214 (i.e., an unlocked portion). Specifically, when the lid 202 is rotated to the closed position 212 the male bayonet fastening mechanism 116 of FIG. 1 may be mated with female bayonet fastening mechanism 118 of FIG. 1, which may allow the rotatable lid assembly 108 to directly compress the liner 112 to the rim 114 of the pot 104 (liner 112, rim 114, and pot 104 not shown in closed position of FIG. 2). Further, when the lid 202 is rotated to the open position 214 the male bayonet fastening mechanism 114 is not mated with female bayonet fastening mechanism 118, which provides for the rotatable lid assembly 108 to be pivoted away from base assembly 106 and into the open position as illustrated in FIG. 1. While mark 208 is illustrated in FIG. 2 as being disposed on an outer surface of base 210, it may instead, or also, be disposed on an outer surface of lid ring 204.

Figure 3:
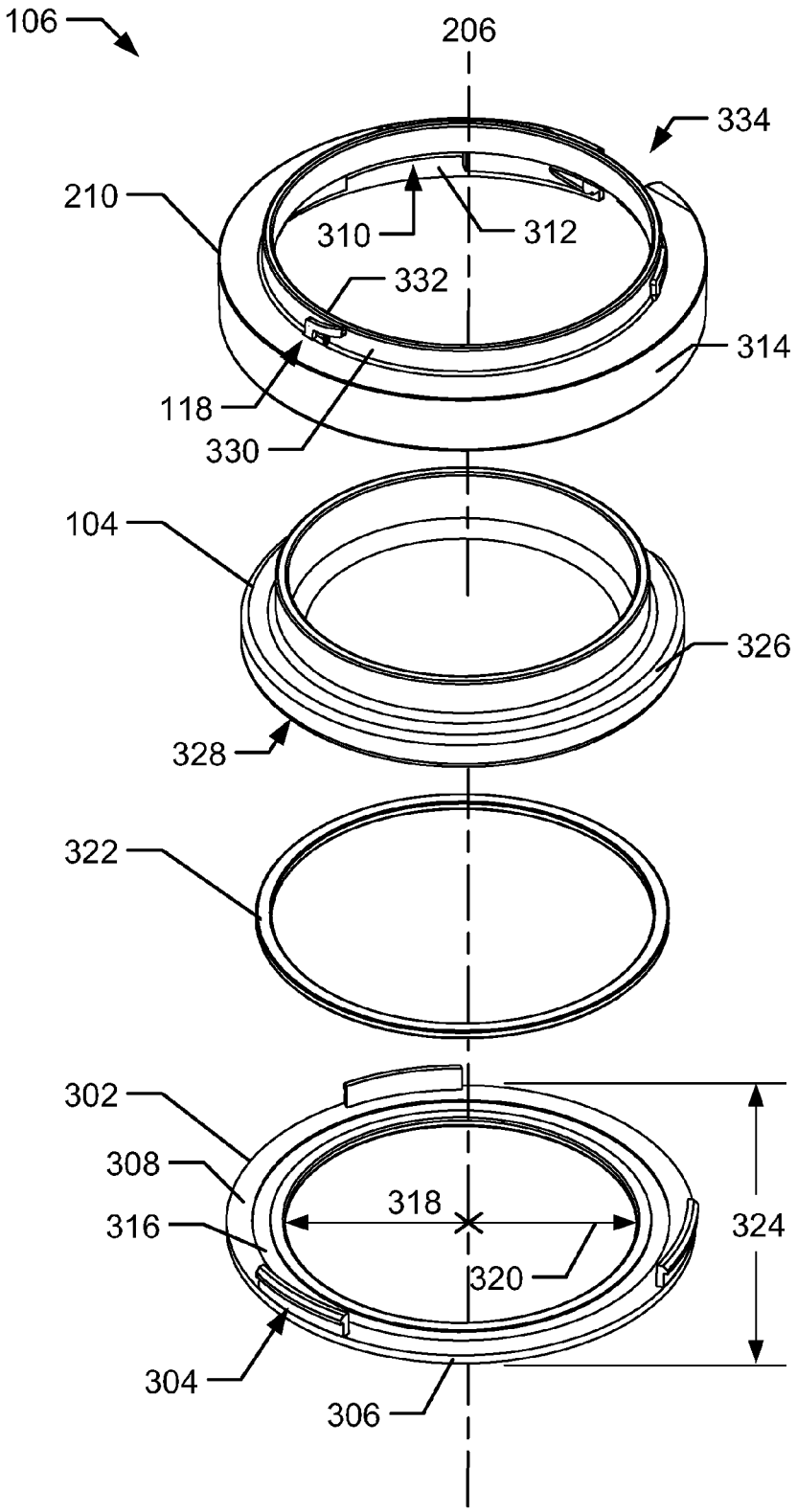
FIG. 3 illustrates an exploded isometric view of the base assembly of the airtight compact shown in FIGS. 1 and 2.

FIG. 3 illustrates an exploded isometric view of the base assembly 106 of the airtight compact 102 shown in FIGS. 1 and 2. As described above, base assembly 106 may be configured to at least partially encase pot 104. FIG. 3 illustrates a base plate 302 configured to couple to base 210. Specifically, base plate 302 may comprise one or more fastening protrusions 304 arranged along a perimeter 306 of a planar top surface 308 of the base plate 302. The one or more fastening protrusions 304 may be configured to be received by one or more pockets 310 arranged along an inside surface 312 of a first outer wall 314 of base 210. While FIG. 3 illustrates base plate 302 comprising fastening protrusions 304 for fastening base plate 302 to base 210, other fastening mechanisms are contemplated. For example, base plate 302 and base 210 may be fastened together via a threading mechanism, a bayonet fastening mechanism, a press fit mechanism, combinations of the foregoing, or the like. Further, base plate 302 and base 210 may be removably fastened together to allow a user to interchange the pot 104.

FIG. 3 further illustrates an o-ring groove 316 disposed about a center 318 of an opening 320 as well as in the planar top surface 308 of the base plate 302. While FIG. 3 illustrates a standard o-ring groove 316 it is contemplated that the o-ring groove 316 may also, or additionally, be a captive o-ring groove. Further, an o-ring 322 configured to be installed into o-ring groove 316 is illustrated in FIG. 3, which may be interposed between the pot 104 and the base plate 302. O-ring 322 may supplement manufacturing tolerances of the base assembly 106, and/or may dampen the pot 104 partially encased by the base assembly 106. More specifically, o-ring 322 may supplement a manufacturing tolerance associated with the pot 104 (i.e., a glass pot). Further, fastening protrusions 304 and pockets 310 are configured to couple together via a snap fit of the base plate 302 to the base 210, with respect to the manufacturing tolerance of the pot 104 and the compression of the o-ring 322. In this example, base plate 302 is illustrated as comprising a single circular opening 320 having a diameter approximately about 1.25 times smaller than a diameter 324 of base plate 302. However, other sizes and/or shapes may also be used. For example circular, rectangular, triangular, combinations of the foregoing, or the like that are suitable for providing visibility to the pot 104 and the volatile product contained therein are contemplated.

FIG. 3 further illustrates the pot 104 being translucent and formed of glass, configured to receive and contain a volatile product (not shown), comprising an outer wall 326 and bottom surface 328. More specifically, base plate 302 may be configured to be disposed along the bottom surface 328 of pot 104 and base 210 may be configured to be disposed about the outer wall 326 of pot 104. Here FIG. 3 illustrates the base 210 having a female bayonet fastening mechanism 118 arranged along an outer surface 330 of a second outer wall 332 of the base 210 for mating with the male bayonet fastening mechanism 116 of rotating lid assembly 108. A hinge link 334 is illustrated in FIG. 3 as being disposed in the first outer wall 314 of base 210, which is configured to mate with a hinge link of the lid ring (described below with respect to FIG. 4).

FIG. 3 further illustrates longitudinal axis 206 disposed substantially proximate to center 318 of lid ring 302 with o-ring 322, pot 104, and base 210 all disposed concentric about longitudinal axis 206. While pot 104 has been described here in FIG. 3 as being formed of translucent glass, other materials are contemplated. For example, the pot 104 may be formed of translucent terpolymer, or any other suitable material for containing a volatile or aggressive product. Further, the base plate 302 and base 210 may comprise ABS, SAN, metal, or any other suitable material, or the like that is suitable for encasing and protecting the fragile pot 104, as well as provide the structural strength necessary for mechanical connections (e.g., female bayonet fastening mechanism 118 and hinge link 334).

Figure 4:
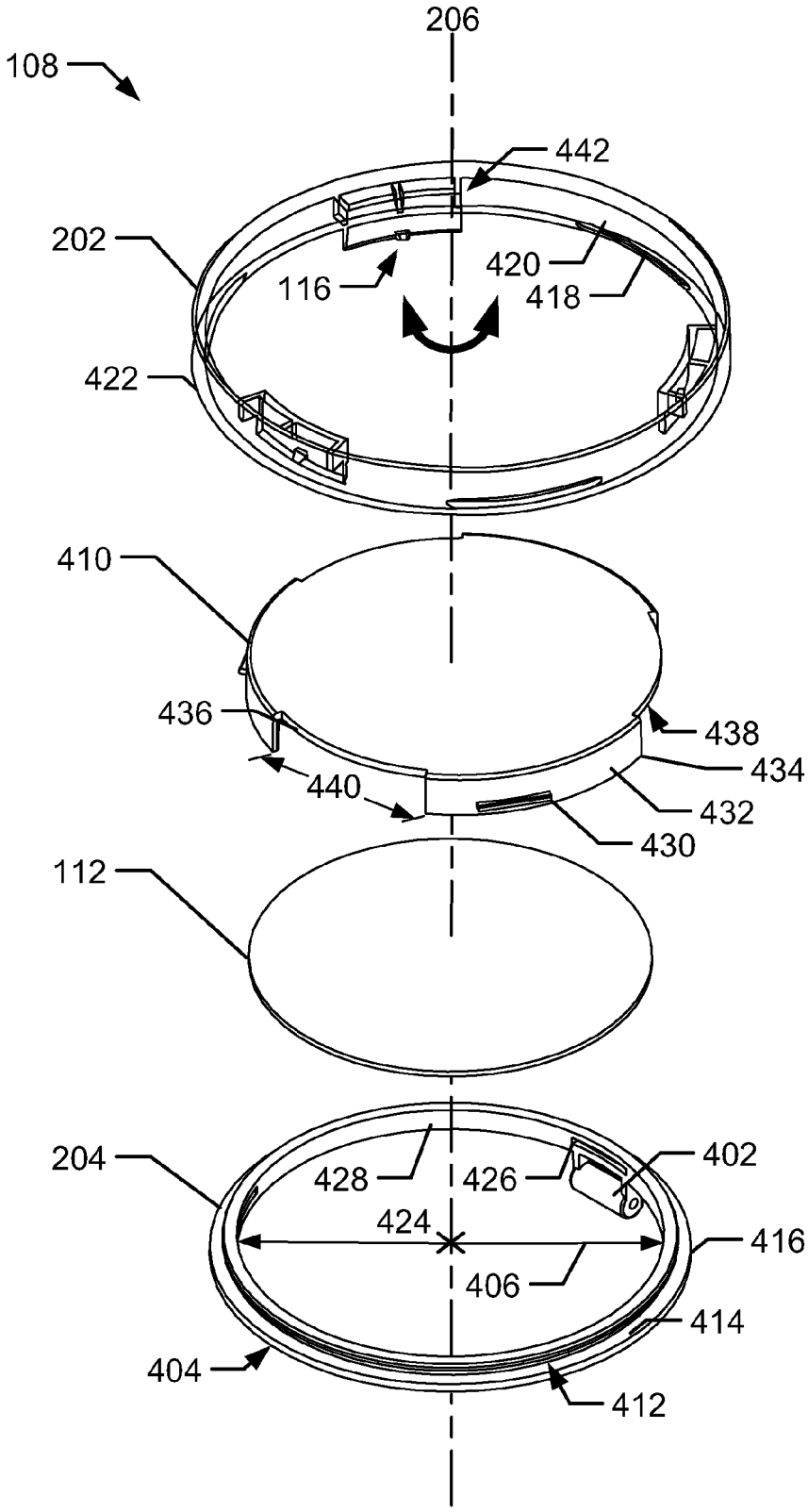
FIG. 4 illustrates an exploded isometric view of the rotatable lid assembly of the airtight compact shown in FIGS. 1 and 2.

FIG. 4 illustrates an exploded isometric view of the rotatable lid assembly 108 of the airtight compact 102 shown in FIGS. 1 and 2. As described above, rotatable lid assembly 108 is configured to be pivotably coupled, via hinge assembly 110, to base assembly 106. Here, FIG. 4 illustrates lid ring 204 configured to pivotably couple to base 210 via hinge link 402. Here, hinge link 402 is illustrated as being disposed on and distal to a bottom surface 404 of the lid ring 204. FIG. 4 further illustrates ring 204 comprising an opening 406 for receiving a portion of the translucent glass pot 104, the base 210, lid 202, and an inner lid 410, when the airtight compact 102 is fully assembled as illustrated in FIGS. 1 and 2. A channel 412 disposed on a top surface 414 of the lid ring 204 is illustrated in FIG. 4 to be oriented towards an outer perimeter 416 of the lid ring 204 opposite to the opening 406. Channel 412 is configured for receiving one or more ribs 418 arranged along an inside surface 420 of a perpendicular wall 422 of the lid 202. The one or more ribs 418 of the lid 202 and the channel 412 of the lid ring 204 provide for the rotation of the lid 202 about a center 424 of the opening 406 of the lid ring 204 when the rotatable lid assembly 108 is assembled.

Further illustrated in FIG. 4 are one or more pockets 426 arranged along a surface 428 of the opening 406. Here, each pocket 426 may be configured to receive a respective one of one or more of ribs 430 of the inner lid 410 and couple (i.e., snap fit) the inner lid 410 to the lid ring 204. FIG. 4 illustrates each of the one or more ribs 430 being disposed on an outer surface 432 of each of one or more perpendicular protrusions 434, where each of the one or more perpendicular protrusions 434 are arranged along a perimeter 436 of a planar bottom surface 438 of the inner lid 410.

FIG. 4 further illustrates one or more gaps 440, disposed between the one or more protrusions 434, arranged along perimeter 436 of the planar bottom surface 438. Each of the one or more gaps 440 of the inner lid 410, when the airtight compact 102 is assembled, provide exposure of the female bayonet fastening mechanism 118 to the lid 202 rotatably coupled to the lid ring 204. More specifically, each of the one or more gaps 440 provide for rotating the lid 202 approximately about twenty-degrees in either a counter clock-wise direction or a clock-wise direction about longitudinal axis 206 disposed substantially proximate to the center 424 of the lid ring 204 to unlock and lock the rotatable lid assembly 108 from the base assembly 106 when fully assembled. Additionally, the male bayonet fastening mechanism 116 is illustrated in FIG. 4 as comprising one or more walls 442. The one or more walls 442 are configured to make contact with each of respective protrusions 432, to limit rotation of the lid 202 about the lid ring 204 when the rotatable lid assembly 108 is assembled. Rotation of the lid 202 is limited to about 20 degrees by engagement of the walls 442 and the protrusions 432. As described above with respect to FIGS. 1 and 2, when lid 202 is rotated in either a counter clock-wise direction or a clock-wise direction about the longitudinal axis 206, the male bayonet fastening mechanism 116 mates/un-mates with the female fastening mechanism 118, which when the lid 202 is in the closed position 214, the liner 112 is directly compressed between the inner lid 410 and the rim 114 of the pot 104.

While FIG. 4 illustrates the liner 112 as being separate from the inner lid 410 it is contemplated that the liner 112 may be made integral with the inner lid 410. For example, it is contemplated that the liner 112 may be over-molded to the bottom surface 438 of the inner lid 410. Further, it is contemplated that the liner 112 may be fastened to the inner lid 410 via an adhesive or the liner 112 may be retained within the inner lid 410 by a groove (not shown) disposed in an inside surface of each of the one or more perpendicular protrusions 434. Here, the liner 112 may comprises silica gel, rubber, TPE, silicone, neoprene, combinations of the foregoing, or the like that is impervious to a volatile product contained in the pot 104. Again, as discussed above, the inner lid 410 may comprise PP, or any other plastic suitable for assembling with the liner 112 and suitable for providing the structural strength necessary for the mechanical connections (e.g., snap fitting inner lid 410 to lid ring 204). Additionally, the lid 202 may comprise ABS, SAN, metal, combinations of the foregoing, or the like.

Example Method for Manufacturing an Airtight Compact

Figure 5:
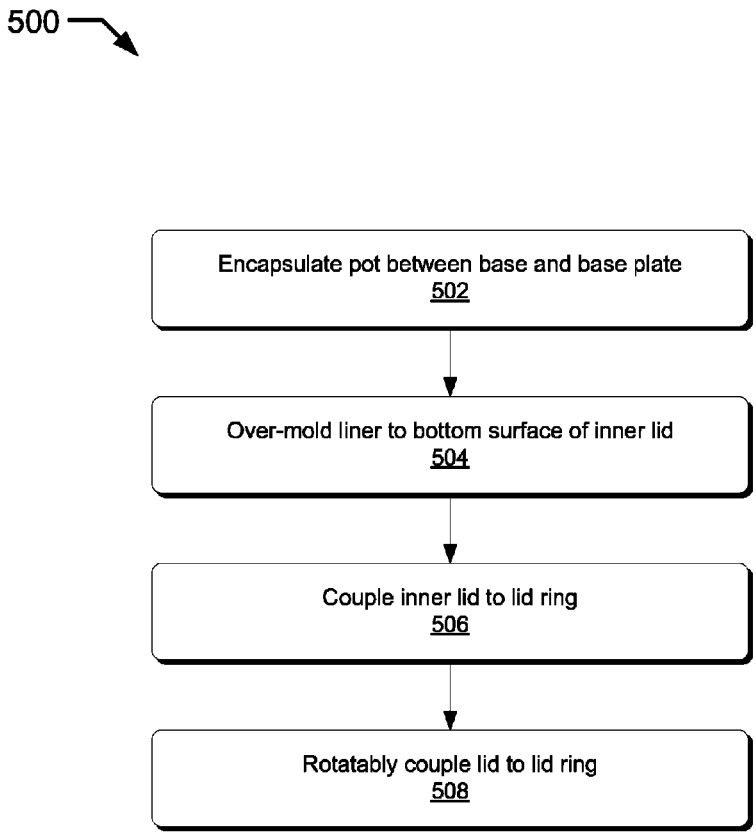
FIG. 5 illustrates an example method for manufacturing the airtight compact shown in FIGS. 1 and 2.

FIG. 5 illustrates an example method 500 for manufacturing an airtight compact (e.g., airtight compact 102) based at least in part on material characteristics of the particular airtight compact. For instance, this process may be performed to manufacture an airtight compact comprising a translucent and fragile pot (e.g., pot 104) partially encased by a base assembly (e.g., base assembly 106), which has a rotatable lid assembly (e.g., rotatable lid 108) pivotably coupled to a base assembly. Where, for example, the pot may be formed of translucent glass or translucent terpolymer and the base assembly and the rotatable lid assembly and each of their respective constituents may be formed of silica gel, rubber, thermoplastic TPE, silicone, neoprene, ABS, SAN, and/or metal, or any other suitable polymer, mixture, or the like that is suitable for forming the airtight compact. In some instances, the process may be performed at a manufacturing facility prior to the shipping of the airtight compact. While FIG. 5 illustrates a method for manufacturing an airtight compact configured to contain a volatile or aggressive product (e.g., cosmetic makeup) until a time of use when the product is applied to a body (e.g., a person's face), this method may apply to the manufacturing of any type of container. For example, the airtight compact may be for containing a medicinal product to be prescribed, an item to be packaged, or a coating to cover a body. Additionally, this process may apply to manufacturing any type of container formed of any other suitable materials capable of being manufactured by injection molding, blow molding, blow-fill-seal processing, or any other suitable manufacturing process.

Method 500 may include an operation 502, which represents encapsulating, at least partially, the translucent pot between a base (e.g., base 210) and a base plate (e.g., base plate 302). Next, the method 500 may continue with operation 504, which comprises over-molding a liner (e.g., liner 112) to a bottom surface (e.g., bottom surface 438) of an inner lid (e.g., inner lid 410) or fixing the liner to the bottom surface of the inner lid with an adhesive. Method 500 may proceed to operation 506, which represents coupling the inner lid to a lid ring (e.g., lid ring 204) via snapping one or more ribs (e.g., one or more ribs 430) of the inner lid into one or more pockets (e.g., one or more pockets 426) of the lid ring. Operation 506 may be followed by operation 508 which rotatably couples a lid (e.g., lid 202) to the lid ring via snapping one or more ribs (e.g., one or more ribs 418) of the lid into a channel (e.g., channel 412) of the lid ring.

Conclusion

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative. Also, while one example of a method of manufacturing is described, containers according to this disclosure may be made using any other suitable manufacturing methods.

What is claimed is:

1. A vessel comprising:

a pot for holding a product;

a base assembly at least partially encasing the pot; and a rotatable lid assembly pivotably coupled to the base assembly at a single pivot axis and configured to removably lock to the base assembly, the rotatable lid assembly comprising:

a lid ring pivotably coupled to the base assembly at the pivot axis;

a lid rotatably coupled to the lid ring, wherein the lid comprises one or more ribs configured to be received by a channel of the lid ring and provide for rotation of the lid about a center of an opening of the lid ring;

an inner lid coupled to the lid ring; and a liner fixed to a bottom surface of the inner lid, the liner being configured to seal the rotatable lid assembly to a rim of the pot wherein the channel is disposed on a top surface of the lid ring and oriented towards an outer perimeter of the lid ring.

2. The vessel of claim 1, wherein the pot comprises translucent glass or translucent terpolymer.

3. The vessel of claim 1, wherein the base assembly comprises:

a base disposed about an outer wall of the pot;

a base plate coupled to the base and disposed along a bottom surface of the pot; and an o-ring disposed about a center of an opening of the base plate and interposed between the pot and the base plate.

4. The vessel of claim 3, wherein the base, the base plate, the lid, and the lid ring comprise acrylonitrile butadiene styrene (ABS), styrene acrylonitrile (SAN), and/or metal.

5. The vessel of claim 1, wherein the liner is over-molded to the bottom surface of the inner lid.

6. The vessel of claim 5, wherein the liner comprises silica gel, rubber, thermoplastic elastomer (TPE), silicone, or neoprene, and wherein the inner lid comprises polypropylene (PP).

7. A compact comprising:

a translucent glass pot impervious to a volatile product, the translucent glass pot at least partially encased by (i) a base disposed about an outer wall of the translucent glass pot, and (ii) a base plate coupled to the base and disposed along a bottom surface of the translucent glass pot; and a rotatable lid assembly pivotably coupled to the base configured to removably lock to the base and seal the translucent glass pot, the rotatable lid assembly comprising;

a lid ring pivotably coupled to the base, the lid ring comprising:

an opening for receiving a portion of the translucent glass pot, the base, a lid, and an inner lid, wherein a channel is disposed on a top surface of the lid ring and oriented towards an outer perimeter of the lid ring opposite the opening;

one or more pockets arranged along a surface of the opening; and a hinge link disposed on and distal to a bottom surface of the lid ring;

the lid rotatably coupled to the lid ring, wherein the lid comprises one or more ribs arranged along an inside surface of a wall of the lid, the one or more ribs configured to be received by the channel of the lid ring and provide for rotation of the lid about a center of an opening of the lid ring;

the inner lid coupled to the lid ring; and a liner over-molded to the bottom surface of the inner lid, the liner being configured to be impervious to the volatile product and seal the rotatable lid assembly to a rim of the translucent glass pot.

8. The compact of claim 7, wherein the lid rotatably coupled to the lid ring comprises:

a perpendicular wall disposed along a perimeter of a bottom surface of the lid, wherein the one or more ribs are arranged along an inside surface of the perpendicular wall of the lid; and a male bayonet fastening mechanism arranged along the perimeter of the bottom surface of the lid.

9. The compact of claim 7, wherein the inner lid coupled to the lid ring comprises:

one or more perpendicular protrusions arranged along a perimeter of a planar bottom surface of the inner lid;

one or more ribs, each of the one or more ribs being disposed on an outer surface of each of the one or more perpendicular protrusions and configured to be received by each of the one or more pockets of the lid ring; and one or more gaps, disposed between the one or more protrusions, arranged along the perimeter of the planar bottom surface.

10. The compact of claim 9, wherein the base disposed about the outer wall of the translucent glass pot comprises:

another hinge link disposed in a first outer wall of the base configured to mate with the hinge link of the lid ring;

a female bayonet fastening mechanism arranged along an outer surface of a second outer wall of the base, wherein the female bayonet fastening mechanism is exposed to the lid rotatably coupled to the lid ring via the one or more gaps of the inner lid; and one or more pockets arranged along an inside surface of the first outer wall.

11. The compact of claim 10, wherein the base plate coupled to the base and disposed along the bottom surface of the translucent glass pot comprises:

an opening for providing visibility to the translucent glass pot at least partially encased by the base and the base plate;

one or more fastening protrusions arranged along a perimeter of a planar top surface of the base plate configured to be received by each of the one or more pockets arranged along the inside surface of the first outer wall of the base; and an o-ring groove disposed about a center of the opening of the base plate and in a planar top surface of the base plate.

12. The compact of claim 11, further comprising an o-ring disposed in the o-ring groove of the base plate and interposed between the translucent glass pot and the base plate.

13. The compact of claim 7, wherein the base, the base plate, the lid, and the lid ring comprise acrylonitrile butadiene styrene (ABS), styrene acrylonitrile (SAN) and/or metal.

14. The compact of claim 7, wherein the liner comprises silica gel, rubber, thermoplastic elastomer (TPE), silicone, or neoprene, and wherein the inner lid comprises polypropylene (PP).

* * * * *